US007845053B2

(12) United States Patent
Marsh et al.

(10) Patent No.: US 7,845,053 B2
(45) Date of Patent: Dec. 7, 2010

(54) INTEGRATED HINGE ASSEMBLY WITH SPRING BIASED PROP ARM

(75) Inventors: Christopher A. Marsh, Stouffville (CA); Gabriele W. Sabatini, Keswick (CA); Christopher P. Nyholm, Newmarket (CA)

(73) Assignee: Warren Industries Ltd., Concord, Ontario (CA)

( * ) Notice: Subject to any disclaimer, the term of this patent is extended or adjusted under 35 U.S.C. 154(b) by 611 days.

(21) Appl. No.: 11/822,923

(22) Filed: Jul. 11, 2007

(65) Prior Publication Data

US 2008/0016651 A1 Jan. 24, 2008

Related U.S. Application Data

(60) Provisional application No. 60/831,470, filed on Jul. 18, 2006, provisional application No. 60/841,533, filed on Sep. 1, 2006, provisional application No. 60/846,092, filed on Sep. 21, 2006, provisional application No. 60/875,815, filed on Dec. 20, 2006, provisional application No. 60/881,135, filed on Jan. 19, 2007.

(51) Int. Cl.
*E05D 11/06* (2006.01)

(52) U.S. Cl. ..... 16/357; 16/286; 16/306

(58) Field of Classification Search ..... 16/357, 16/361, 296–298, 285–287, 289, 278, 306–308, 16/366, 370; 49/386, 333; 180/89.17, 69.12; 296/193.11, 76, 56, 146.11, 146.12, 146.8, 296/146.9

See application file for complete search history.

(56) References Cited

U.S. PATENT DOCUMENTS

| | | | | | |
|---|---|---|---|---|---|
| 2,210,762 | A | * | 8/1940 | Itzigson | 296/97.9 |
| 2,272,230 | A | | 2/1942 | Van Voorhees | |
| 2,308,759 | A | * | 1/1943 | Joachim | 16/295 |
| 2,435,670 | A | * | 2/1948 | Buehler | 220/815 |
| 2,612,651 | A | | 10/1952 | Roethel | |
| 2,639,462 | A | * | 5/1953 | Fish | 16/302 |
| 2,702,401 | A | * | 2/1955 | Vigmostad et al. | 16/302 |
| 2,720,676 | A | * | 10/1955 | Vigmostad | 16/289 |
| 2,751,625 | A | * | 6/1956 | Vigmostad | 16/294 |

(Continued)

FOREIGN PATENT DOCUMENTS

DE 42 40 790 C1 2/1994

*Primary Examiner*—Chuck Y. Mah

(57) ABSTRACT

A hinge assembly for use with a pivotally movable closure panel is operable to provide a counterbalancing force to lock or hold the closure panel in an open configuration against a predetermined threshold closure force without the need of separate support components such as gas-charged struts or prop rod. The hinge assembly is provided with upper and lower hinge arms which are pivotally connected towards their rearward ends for movement relative to each other for pivotal movement about a hinge pivot axis. A generally elongated or guide slot is formed in the lower hinge arm. A prop arm is pivotally secured at a first end to a forward portion of the upper hinge arm forwardly from the hinge pivot axis. A sliding member is secured toward the second other end of the prop arm and engages the guide slot so as to be reciprocally movable therealong as the hinge arms are moved between a fully closed and fully open positions. The guide slot includes an operational section and an engaged section. A resilient biasing member is used to engage and bias the sliding member forwardly relative to the guide slot as it moves through the engaged section while disengaging from or passively engaging the sliding member as it moves along the operational section of the guide slot.

36 Claims, 9 Drawing Sheets

U.S. PATENT DOCUMENTS

| | | | | | |
|---|---|---|---|---|---|
| 2,908,934 | A | | 10/1959 | Ragsdale | |
| 3,069,720 | A | | 12/1962 | Gessler | |
| 4,188,684 | A | | 2/1980 | Pennec | |
| 4,206,944 | A | | 6/1980 | Kumagai | |
| 4,236,272 | A | | 12/1980 | Gronbach | |
| 5,050,270 | A | | 9/1991 | Burgei | |
| 5,062,182 | A | * | 11/1991 | Griffiths et al. | 16/368 |
| 5,169,221 | A | * | 12/1992 | Wheeler | 312/323 |
| 5,235,725 | A | * | 8/1993 | Rees | 16/298 |
| 6,269,521 | B1 | * | 8/2001 | Gabel | 16/287 |
| 6,609,583 | B2 | | 8/2003 | Schillaci | |
| 6,755,268 | B1 | | 6/2004 | Polz | |
| 6,892,843 | B2 | | 5/2005 | Schillaci | |
| 2001/0005920 | A1 | * | 7/2001 | Kim | 16/334 |
| 2003/0172920 | A1 | | 9/2003 | Gronbach | |
| 2006/0225247 | A1 | * | 10/2006 | Duffy | 16/307 |

* cited by examiner

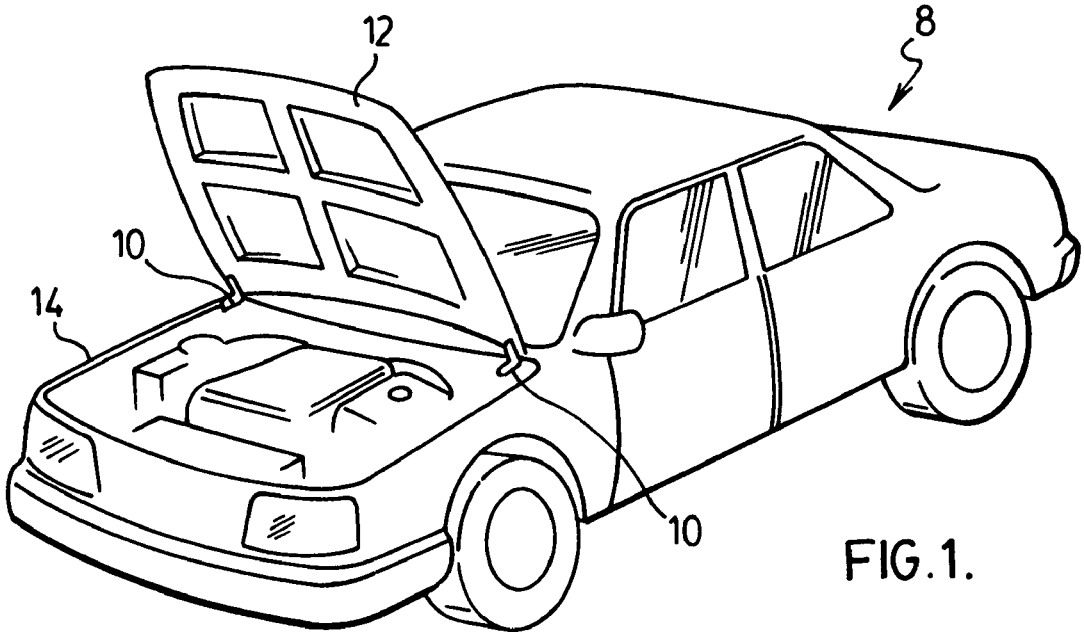
FIG.1.
FIG.2.
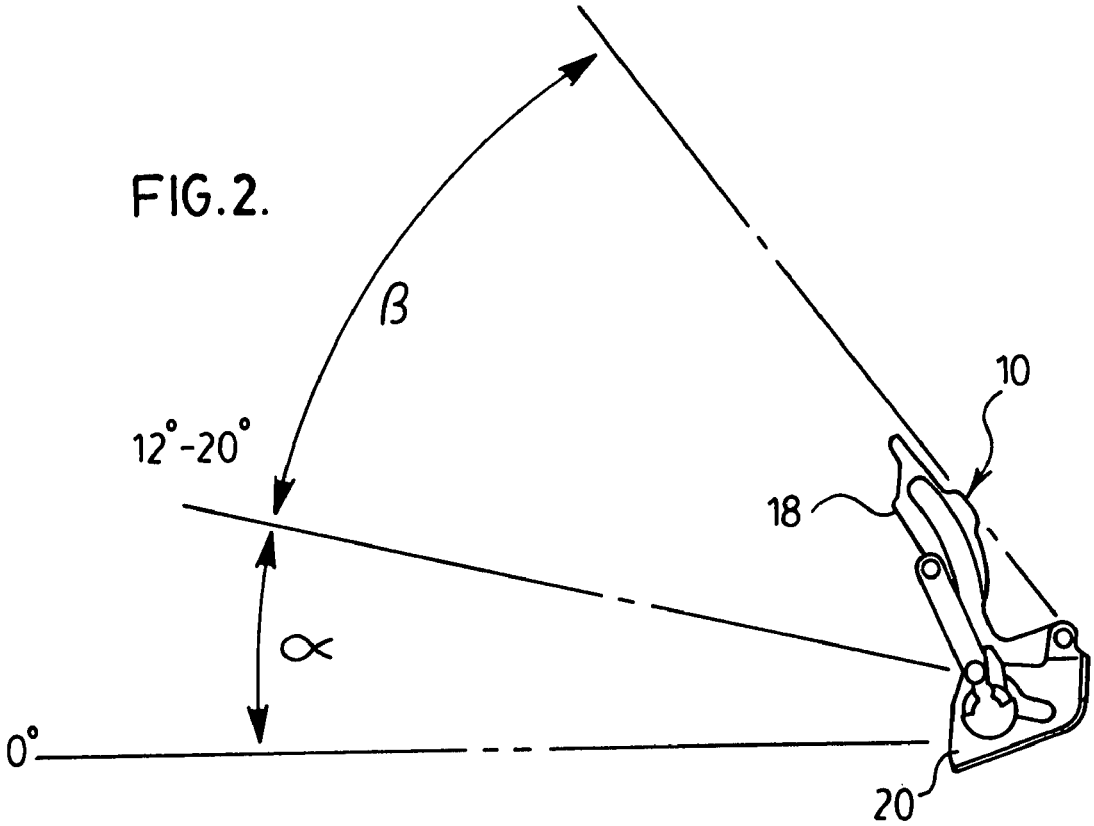

FIG. 5.
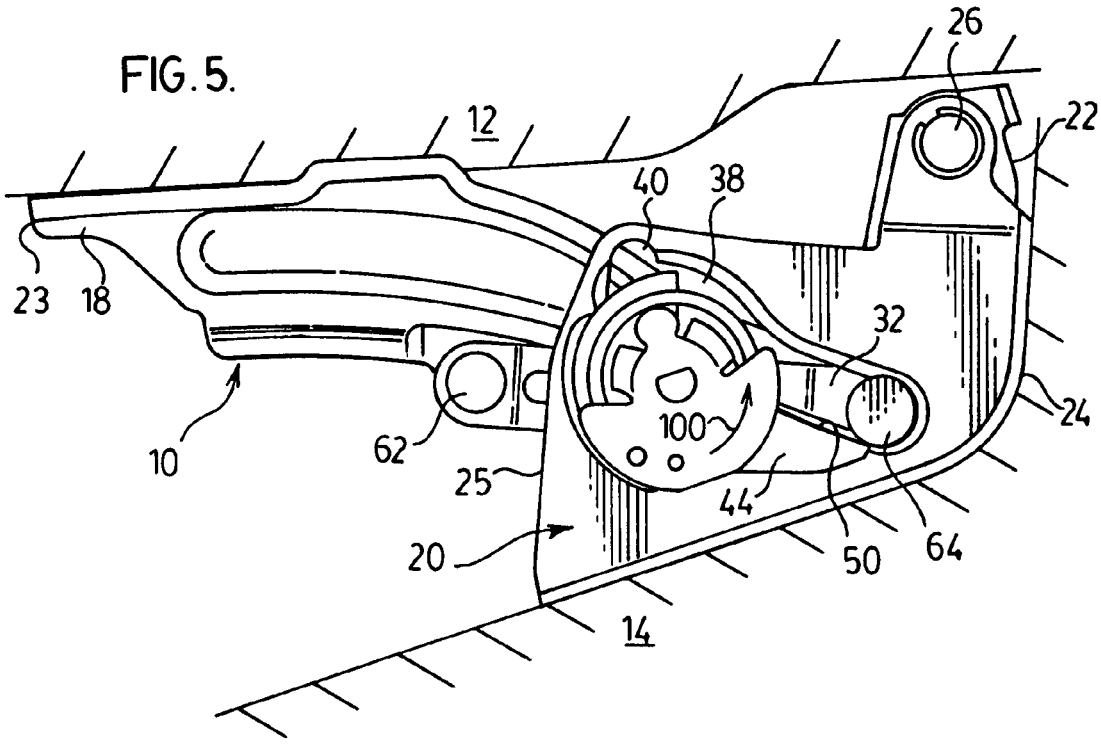
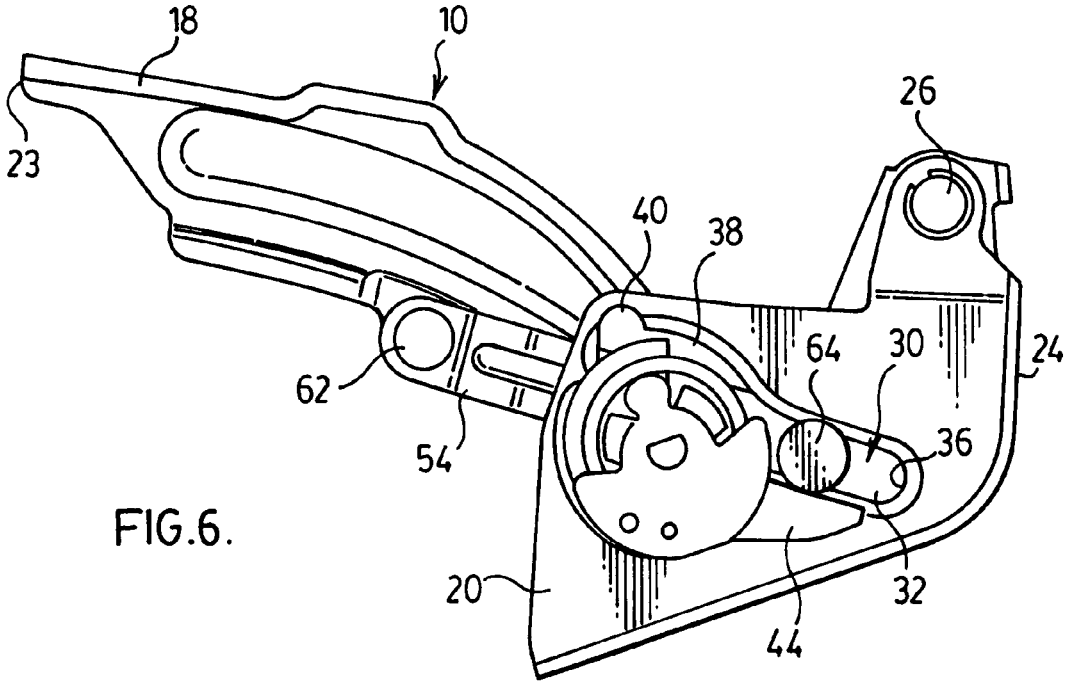
FIG. 6.

INTEGRATED HINGE ASSEMBLY WITH SPRING BIASED PROP ARM

RELATED APPLICATIONS

This application claims the benefit under 35 USC 119(e) to the applicant's earlier filed U.S. provisional application Ser. No. 60/831,470 filed 18 Jul. 2006; U.S. provisional application Ser. No. 60/841,533 filed 1 Sep. 2006; U.S. provisional application Ser. No. 60/846,092 filed 21 Sep. 2006; U.S. provisional application Ser. No. 60/875,815 filed 20 Dec. 2006; and U.S. provisional application Ser. No. 60/881,135 filed 19 Jan. 2007.

SCOPE OF THE INVENTION

The present invention relates to a hinge assembly suitable for use with a vehicle hood or trunk, airplane door or other closure panel. More particularly, the hinge assembly includes a prop arm which is operable to secure the closure panel in an open position to prevent the unintentional closing of the hinge arms against a closing force selected less than a predetermined threshold force, without the use of conventional gas-charged struts or conventional prop rods.

BACKGROUND OF THE INVENTION

In automobile manufacture, hinge assemblies are used to pivotally secure closure panels such as tail gates, trunk lids, bonnets and/or hoods to the vehicle frame, or any other type of closure. Conventional car hinges consist of a pair of steel hinge arms which are movably connected to each other by one or more pivots, and which are bolted respectively to one of the closure panel and the car frame. To maintain the car hood in an open position, as for example to permit servicing of the engine, it is known to provide either supplementary gas-charged struts or a prop rod in conjunction with the hood hinges.

The use of hinge mechanisms in conjunction with gas-charged struts advantageously enables the hood to be opened or closed by only one hand of the user. As the hood is opened, gas pressure within the strut acts as a counterbalance to the weight of the hood, and helps to open and hold open the hood/closure panel by supporting the weight of the hood through the force generated by gas pressures within the struts. To close the hood, the user merely applies an added minimum downward pressure on the hood which is sufficient to overcome the resistive force of the struts. Gas struts suffer disadvantages, however, in that over time as a result of wear and seal failures, the struts tend to lose their effectiveness and may require replacement. In addition, as a practical matter, the increased manufacturing costs of gas struts has resulted in their limited use to date. In particular, gas struts are used almost solely with more expensive luxury automobiles, sport utility vehicles and/or vehicles designed with ergonomic difficulties for the end user to open or close the closure panel.

Conventional hood hinge assemblies used with less expensive vehicles are most often provided in conjunction with an elongated prop rod which is hingely mounted along the front of the vehicle under the hood. These hinge systems suffer the disadvantage in that they require two handed operation. In particular, in use, it is necessary to hold open the hood with one hand, and thereafter release, raise and position the prop rod with the other hand, typically orienting the end of the prop rod within a slot or opening formed in a forward underside portion of the hood. When closing the hood, two hands must again be employed, with one hand used to partially raise the hood a certain amount to allow the upper end of the prop rod to be disengaged from the hood slot, and the other to simultaneously lower and reposition the prop rod in a storage operation.

In an effort to attempt to overcome some of the disadvantages of prior art devices, U.S. Pat. No. 6,892,843 B2 to Schillaci et al describes a prop assembly for use in securing a vehicle hood in an open orientation, without the use of a conventional prop rod. In Schillaci, the hinge itself is provided with a rigid prop member which is pivotally connected at an upper end to the hood hinge arm. The lower end of the prop rod is slidably received within a guide slot which extends in an inclined orientation along the car body away from the hinge pivot, and which includes at a proximal most downwardly extending detent. The lower end of the prop rod drops into the detent as the hood is fully opened, to thereby brace the hinge arm in the open orientation.

Schillaci suffers a disadvantage in that to release the hinge and close the hood, it is necessary for an individual to stand to the side of the car adjacent to the hinge, and manually raise both the hood and the end of the prop rod from the detent by means of a release lever. Schillaci therefore continues to require a two-handed operation of the hinge assembly in closing operation. In addition, because the prop rod is released from its position with the user standing beside the vehicle, Schillaci suffers further disadvantages in that it is difficult for shorter and/or physically weaker users to raise the hood when standing to the vehicle side, as in such a position almost the entire weight of the hood is forward from the user. In addition, with Schillaci once the prop rod is released, it may be necessary for the user to reposition him or herself in front of the car to thereafter secure the hood closed in a fully latched configuration.

SUMMARY OF THE INVENTION

To at least partially overcome some of the disadvantages associated with prior art devices, the present invention seeks to provide a hinge assembly suitable for use in the opening and closing of not only vehicle hoods, trunks, or deck lids, hatchbacks, tail and tailgates, but also baggage compartment doors, airplane doors, furniture lids or other such closure panel (hereinafter generically referred to as closure panels). Most preferably, the hinge assembly is operable by a user using only one hand, and without the need for either gas-charged struts or conventional prop rods to secure the raised closure panel in place in an open position against closure or downward forces which are less than a selected predetermined threshold force.

Another object of the invention is to provide a hinge assembly which is adapted to secure a vehicle closure panel in an open position over an opening, and which may be quickly and easily locked in place and/or released through one-handed operation.

Another object of the invention is to provide a hinge assembly for a vehicle which includes a prop arm which is provided with a releasable toggle, locking tab member or pawl operable to secure the vehicle hood and/or trunk in an open position against accidental closure, and which may be released by applying a simple downward force greater than predetermined threshold force, to thereby allow closing in final securement of the hood/trunk with a user standing in front or behind the vehicle.

A further object of the invention is to provide a hinge assembly in which the prop arm includes a spring biased guide pin, movable pawl or tab which is slidable to assist in the securement of a prop arm in an engaging position, where the prop rod prevents against accidental hinge closure. The pin, pawl or tab is movable relative to a guide track or slot from an operational section which allows for manual opening and closing of the closure panel in a conventional manner, without the spring significantly affecting hinge operation, into an engaged section, whereby the spring supplies at least a partial force on the prop arm to urge the hinge towards an open orientation.

Another object of the invention is to provide one or more locking hinge mechanisms for use in securing a vehicle bonnet, hood, trunk or deck lid, hatchback, lift back, lift or other closure panel in a locked open orientation, and which in operation provides an upward counterbalancing force, to at least partially offset the dead weight of the closure panel in a manner similar to that of a conventional gas strut.

A further object of the invention is to provide a pair of automobile hinge assemblies for coupling a vehicle hood to the vehicle frame. In operation, the hinge assemblies provide a counterbalancing force greater than the downward force applied by the vehicle hood weight once the hood has been manually raised to a pre-selected angle, to effect further opening of the hood either with minimal further manual lifting force, or more preferably without requiring any further manual lifting force by the user.

Another object of the invention is to provide a hinge assembly for use in connecting a closure panel to a frame, and which includes a pair of pivotally movable hinge arms, and a spring biased prop arm assembly for securing the hinge arms in an open orientation, and wherein the hinge spring is tunable to permit adjustment of the spring force applied to the prop arm.

Still another object of the invention is to provide a hinge assembly which is adapted for use in securing a vehicle deck lid or tailgate to a vehicle frame, and which is tunable for use on a variety of different automobiles to provide a counterbalancing force which has a similar feel to gas charged struts.

A further object of the invention is to provide a locking hinge assembly which possesses a simplified construction for use in securing a closure panel in a locked open orientation, and which may be unlocked by the one-handed application of a predetermined minimum threshold downward force, allowing the closure panel to be closed in a simplified downward movement.

The present invention provides a biasing or prop mechanism which includes a pair of movable plates or arm members which are engaged by a sliding member. Most preferably, the prop/biasing mechanism may be used as part of a hinge, tensioner, or other structure where a force is applied on a prop rod to create an opening, closing or tensioning motion. Most preferably, the prop mechanism comprises a hinge assembly for use with a pivotally movable closure panel such as a vehicle hood or trunk, airplane or railcar door, or other furniture lid or component. More particularly, one or more hinge assemblies are adapted to pivotally secure the closure panel to a frame, allowing it to be opened or closed. In use, the hinge assembly is operable to provide a counterbalancing force to lock or hold the closure panel in an open configuration relative against a predetermined threshold closure force without the need of separate support components, such as gas-charged struts or prop rods. Most preferably, the hinge assemblies are selected such that the total counterbalancing force applied by the hinge assemblies exceeds the closure force applied by the weight of the closure panel.

Each hinge assembly is provided with upper and lower hinge brackets, plates or arms (hereinafter generally referred to as hinge arms), which respectively are either integrated into or positioned for coupling directly or indirectly to the closure panel and the adjacent frame. The upper and lower hinge arms are pivotally connected towards their rearward ends for movement relative to each other either by one or more hinge pivots or pins, or for compound pivotal movement about a hinge pivot axis by way of one or more linkage arms pivotally connected to each other at points along the hinge arms.

A generally elongated slot, track or other guidance member (hereinafter collectively and generally referred to as a guide slot) is formed either as a separate member connected to the closure panel or frame, or more preferably is formed on or in the second other hinge arm, with the hinge assembly formed as a pre-manufactured integral unit.

The hinge assembly further includes a prop arm which may be pivotally coupled towards its first end to either the closure panel, the vehicle or furniture frame. More preferably, however, the first end of the prop arm is pivotally secured to a forward portion of a first one of the hinge arms at a point spaced a distance forwardly from one or more of the hinge pivot axis. A guide pin, boss, tab member, prong or pawl (hereinafter collectively generally referred to as a sliding member) is secured toward the second other end of the prop arm. The sliding member engages the guide slot so as to be reciprocally movable therealong as the hinge arms are moved between a fully closed and fully open positions. As will be described, the relative positioning of the sliding member along the guide slot is used to achieve either free movement or locking the hinge assembly in an open position under normal load forces.

The applicant has appreciated that by introducing minor changes to the orientation and curvature of the guide slot and/or the position of pivotal coupling of the prop arm, adjustments may be made to the hinge assembly to permit its tuning without changing or altering spring tension. This enables the use of the hinge assembly to provide a suitable counterbalancing force on a variety of different vehicle models and/or makes.

In a simplified design, the guide slot includes a free operational section where the hinge assembly operates so as to allow the closure panel to be manually opened and closed in a conventional manner, and an engaged section where the hinge assembly moves to provide a positive counterbalancing force on the closure panel, as for example, to assist in preventing movement of the closure panel from open orientation under its own weight.

The operational section is generally elongated and extends forwardly from a rearwardmost bight spaced towards the hinge pivot axis to merge at its forwardmost end with the engaged section. The operational section may be straight, angled and/or curved. Most preferably, the operational section is formed as a parallel sided guide slot and is oriented to allow reciprocal movement of the sliding member therealong. In a preferred construction, the engaged section of the guide slot extends in a generally arcuate or otherwise partially transverse direction to the operating section. Optionally, the engaged portion may also include upper and/or lower detent portions which physically allow the sliding member to move therein to assist in allowing the closure panel to move to a more fully open position, allowing greater access to the vehicle.

Preferably, the hinge assembly also includes a resilient biasing member which is used to selectively assist in biasing the sliding member forwardly relative to the guide slot. Suitable biasing members may include without limitation electric motors, torsion springs, helical compression spring, extension springs, coil springs, or in an alternate construction gas-charged struts. Although not essential, preferably the biasing member is configured to either disengage from or largely passively engage the sliding member as it moves along the operational section of the guide slot, with the hinge assembly operating as a largely conventional hinge as the sliding member locates therein. Most preferably, in the operational section, the sliding member does not place increased stresses on the biasing member, as for example so not to otherwise overtension a biasing spring or the like. The applicant has appreciated that by limiting the biasing force on the sliding member in the operational section, the closure panel is not placed under significant stress and thereby, for example, allowing the vehicle hood, lift gate or the like to be manufactured less robustly and more inexpensively.

As the sliding member moves into the engaged section of the slot, the biasing member actively engages the sliding member to provide a gradually increasing positive biasing force thereon, urging the sliding member forwardly. It is to be appreciated that the biasing force between the member or spring and the slidable second end of the prop arm results in a forward force thereon. Preferably, the forward force increases to a point which is selected to act as a counterbalance weight of the closure panel and assist in moving the closure panel to and from the open configuration.

It is furthermore to be appreciated that comparatively smaller spring constructions may be used with differential coil spacing and/or thicknesses to provide variable counterbalancing effects, as for example, the hinge assembly is opened past and/or between predetermined threshold amounts.

In a simplified construction, the hinge assembly is used as a vehicle hood hinge. The guide slot is formed in the lower hinge arm so as to extend forwardly from a rear portion spaced towards the pivot axis, to a forwardmost end portion, with the prop arm being pivotally connected towards a forward end of the upper hinge arm. It is to be appreciated, however, that the hinge assembly could equally be provided in the reverse orientation, with the prop arm pivotally fixed to the lower hinge arm or even the vehicle frame, and the guide slot provided along the length of the upper hinge arm or formed in the hood. As the hood is raised, and the upper hinge arm is pivoted relative to the lower arm about the hinge pivot and pivot axis, the relative movement of the hinge arms results in the second end of the prop arm and the sliding member being slid forwardly along the operational section of the guide slot.

In a preferred embodiment, the engaged section of the guide slot extends forwardly along a generally arcuate curving path which extends radially about a path axis. A spring biased toggle arm is pivotally secured to the hinge assembly. Although not essential, most preferably the toggle arm is provided with a generally non-linearly or curving engagement surface which is configured for engaging contact with the sliding member as it reciprocally moves along the slot. The toggle member is resiliently movable between an initial biased position, where the engagement surface of the toggle arm is moved adjacent to a side of the operational section of the guide slot so as not to substantially interfere with the sliding movement of the guide member thereon, to an engagement position, wherein the engagement surface is positioned in an orientation at least partially transverse to the direction of elongation of the slot. As the sliding member moves from the operational section of the slot into the engaged section, the rotational movement of the toggle member and contact between the engagement surface and sliding member applies an increasing forward force on the sliding member, reaching a predetermined force to urge the sliding member to move forwardly along the guide slot. This forward movement of the guide member results in the prop arm forcing the hinge arms apart, moving the closure panel towards the open position.

The applicant has appreciated that by adjusting the curvature or angle of the guide slot path and/or the shape of the contact surface of the toggle member or length of the pivot arm may also be used to tune the hinge for use in different applications and/or with different vehicle hoods, lift gates or the like. As such, the present hinge construction provides greater versatility enabling the same hinge parts to be used on a variety of different vehicle types or models with minor adjustment to one or more hinge components such as the spring, guide slot, prop arm and/or toggle arm.

Optionally, the engaged section of the guide slot may include an upper extending detent at its forwardmost end. As the hinge arms move to the fully opened position, the guide member is urged into alignment with the detent, so as to be movable therein to allows the hood to be opened to a greater than normal angle to facilitate access.

In another possible construction, a keeper recess, catch arm, locking hook or other catch member may be used to engage the guide member as it moves to the forward end of the slot, to assist in locking the hinge arms in an open configuration.

To close the vehicle hood, a manual downward force is applied on the hood which is sufficient to move the sliding member downwardly out of alignment with the detent, if any, and rearwardly along the slot, and which exceeds the upward counterbalancing force applied thereagainst the toggle arm. The downward movement of the upper hinge arm results in the sliding member returning rearwardly along the engaged section of the guide slot against the bias of the toggle and spring. Movement of the sliding member along the slot most preferably results in the toggle arm being repositioned to reassume an orientation with its engagement surface parallel to a section of the slot. As the sliding member returns towards the operational section of the slot, most preferably the toggle member provides a gradually decreasing forward force on the sliding member, most preferably reaching a neutral or zero forward force thereon as the sliding member returns into the operational section of the slot. Once so positioned, the sliding member is again passively engaged, so as to freely move along the operational section of the slot without being subjected to significant forward forces. The applicant has appreciated that while not essential, here the effect of the spring on the guide pin is minimized eliminating the need of overtensioning the spring and lengthening spring life. In addition, the present construction advantageously permits the use of comparatively smaller springs as contrasted with conventional spring triggered hood release mechanisms, enabling the entire hinge assembly to be formed with an overall more compact design. Optionally, the sliding member may be provided with a live bearing to minimize any frictional wear, resulting from the contact forces applied by the toggle arm thereon as it moves long the guide slot.

In an alternate possible construction, the engaged section of the guide slot includes a blind end portion which includes upper and lower detents, such that the blind end is elongated in a direction generally transverse to the direction of elongation of the operational section. Here the sliding member may be formed as a locking pawl having an oval or generally elliptical shape, and a width and length selected to enable it to be slidably retained in or along the guide slot. The locking pawl is rotatably coupled towards one of its ends to the second end portion of the prop arm so as to extend forwardly therefrom when the pawl is positioned adjacent to the rearwardmost bight of the guide slot. Preferably, the pawl is provided as a generally elongated member which has an overall length selected to enable its positioning fully within the blind end portion of the slot. Although not essential, the upper detent extends vertically upward relative to the operational section of the guide slot, with the lower detent extending downwardly therebelow. The relative sizing of the pawl and blind end of the slot are selected to allow the substantially reorientation of the pawl therein to a locking position whereby the pawl is moved substantially angularly to the direction of elongation of the operational section.

Because the prop arm is rotatably mounted at its first end to a forwardmost end of the upper hinge arm, its other second end and the locking pawl are slidably movable along the guide slot as the closure panel is raised. In particular, as the hinge arms move open, the locking pawl slides forwardly along the operational section of the guide slot from the rearwardmost bight and into the blind end. As the locking cam moves forwardly, it moves from the operational section into the blind end where engagement between the sides of the detents and the locking pawl, effects the repositioning of the pawl in the locking orientation. Although not essential, most preferably, in the locking orientation the pawl is repositioned with its longitudinal length moved at an angle of 90°±10° relative to its positioning when in the operational section of the guide slot.

To close the hood or closure panel, the user simply pulls downwardly on the panel with a predetermined minimum threshold force necessary to overcome the spring force and reposition the locking pawl in substantial alignment with the operational section of the slot. Preferably, as the hinge arms are pulled close, the engagement between surfaces of the guide slot return the locking pawl to its original operating configuration, aligned with the longitudinal axis of the operating section. This repositioning allows its return sliding movement along the slot towards the rearwardmost bight, and the folding of the hinge arms to the closed position.

It is to be appreciated, however, that other means of resetting the locking pawl are also possible, including without limitation, flanges, detents, or other physical constructions.

Accordingly, in one aspect the present invention resides in an automobile hinge assembly for hingely coupling an automobile hood to a vehicle frame so as to be selectively movable between open and closed positions about a hinge pivot, the hinge assembly comprising a first hinge arm coupled to one of said hood and said frame, and a second hinge arm coupled to the other of said hood and said frame, each of the hinge arms extending forwardly from a respective proximal end spaced towards said hinge pivot to a distal end remote therefrom, whereby when the hood is moved to the closed position, the distal ends of the hinge arms being moved towards a juxtaposed position, and in the open position the distal ends being moved apart relative therefrom, a guide slot formed in said second hinge arm, the slot including a rearwardmost operational section and an engaged section forwardly from the operational section, the engaged section including a curving portion extending along a generally arcuate path radially spaced from a point axis, a prop arm pivotally coupled at a first end to the first hinge arm at a pivot point spaced forwardly from the hinge pivot, the second other end of the arm including a sliding member slidably engaging said slot for movement therealong, whereby movement of the hood from the closed position to the open position effects sliding movement of the sliding member forwardly along the slot from a rearwardmost position in the operational section to a forwardmost position in the engaged section, a resiliently biased engagement member mounted for engaging contact with the sliding member and being resiliently movable between a release position wherein said engagement member does not substantially interfere with rearward movement of the sliding member along said operational section of said slot, and an engaged position wherein said engagement member engages said prop arm to provide a forward force thereon to assist in forward movement of the sliding member along the engaged section towards the forward position.

In another aspect, the present invention resides in a hinge arm assembly comprising first and second hinge arms, each of the hinge arms extending from a respective proximal end to a distal free end and being coupled for pivotal movement relative to each other about a hinge pivot spaced towards the distal end for movement between a closed position, wherein the free ends of said hinge arms are moved towards juxtaposition, and an open position, wherein the free ends are moved apart, a guide slot formed in said second hinge arm and extending forwardly from a proximalmost end spaced towards the proximal end of the second hinge arm to a distalmost end spaced towards the free end of said second hinge arm, an elongated prop arm pivotally coupled at a first end to the first hinge arm at a pivot point spaced from the hinge pivot towards the first arm free end, a bearing member secured to the second end of the prop arm and being slidably received in the guide slot for movement therealong, whereby movement of the hinge arms from the closed position to the open position effects sliding movement of the bearing member forwardly along the slot from a first position spaced towards the proximalmost end, to a second position spaced towards the distalmost end, a resiliently biased engagement member, the engagement member configured for engagement with the prop arm to urge the bearing member forwardly along the slot.

In a further aspect, the present invention resides in a hinge arm assembly comprising a first pivot member and a second pivot member, each of the first and second pivot members extending from a respective proximal portion to a distal portion, the first and second pivot members being coupled for pivotal movement relative to each other about a hinge pivot spaced towards their respective proximal portions, a generally elongated guide member associated with said second pivot member, the guide member including an operational section and an engaged section, and extending forwardly from a proximalmost end spaced towards the proximal portion of the second pivot member, to a distalmost end spaced towards the second member distal portion, a prop arm extending from a first arm end to a second arm end, the first arm end being pivotally coupled to the first pivot member for movement relative thereto about an arm pivot spaced from the hinge pivot towards the distal portion of the first pivot member, the second arm end being disposed for movement generally along the guide member as the first pivot member is moved about the hinge pivot relative to the second pivot member, a biasing assembly for engaging the prop arm, the biasing member resiliently biasing the second arm end towards the distalmost end of the guide member as the second arm end moves along the at least part of the engaged section to restrict return movement of the second arm end from the engaged section into the operational section absent a predetermined threshold force.

In yet another aspect, the present invention resides in a hinge assembly for hingely coupling a closure panel to a frame so as to be selectively movable between an open and closed position about a hinge pivot, the hinge assembly comprising a first hinge arm coupled to one of said panel and said frame, and a second hinge arm coupled to the other of said panel and said frame, each of the hinge arms extending forwardly from a respective proximal end spaced towards said hinge pivot to a distal end remote therefrom, whereby when the panel is moved to the closed position, the distal ends of the hinge arms being moved towards a juxtaposed position, and in the open position the distal ends being moved apart relative therefrom, a guide slot formed in said second hinge arm, the slot including a rearwardmost operational section and an engaged section forwardly from the operational section, the engaged section extending along a generally arcuate path radially about a path axis, a prop arm pivotally coupled at a first end to the first hinge arm at a pivot point spaced forwardly from the hinge pivot, the second other end of the arm including a bearing member slidably engaging said slot for movement therealong, whereby movement of the hood from the closed position to the open position effects forward sliding movement of the bearing member along the slot from a rearwardmost position in the operational section to a forwardmost position in the engaged section, a toggle member mounted for selective engaging contact with the bearing member and being movable between a release position moved relative to said slot where said toggle member passively engages the bearing member so as not to substantially interfere with rearward movement of the bearing member along the slot, and an engagement position wherein said toggle member actively engages said bearing member to provide a forward force thereon to assist in forward movement of the bearing member along the slot towards the forward position, said toggle member being operable to apply a predetermined minimum force on said bearing member selected generally equal to or greater than a rearward force on the bearing member supplied by the weight of the closure panel when said bearing member is moved along at least part of said engaged section.

BRIEF DESCRIPTION OF THE DRAWINGS

Reference may now be had to the following detailed description taken together with the accompanying drawings in which:

FIG. 1 illustrates a perspective view of an automobile incorporating a pair of integrated hinge assemblies in accordance with a preferred embodiment of the invention;

FIG. 2 illustrates schematically a hinge assembly used in the automobile of FIG. 1 illustrating the range of relative motion of the hinge arms between fully opened and fully closed positions;

FIG. 5 illustrates a schematic first side view of the hinge assembly of FIG. 3 with the hinge arms positioned in the initial fully closed orientation;

FIG. 6 illustrates a schematic side view of the hinge assembly shown in FIG. 5 with the hinge arms moved in an initial partially opened position;

DETAILED DESCRIPTION OF THE PREFERRED EMBODIMENTS

Figure 3:
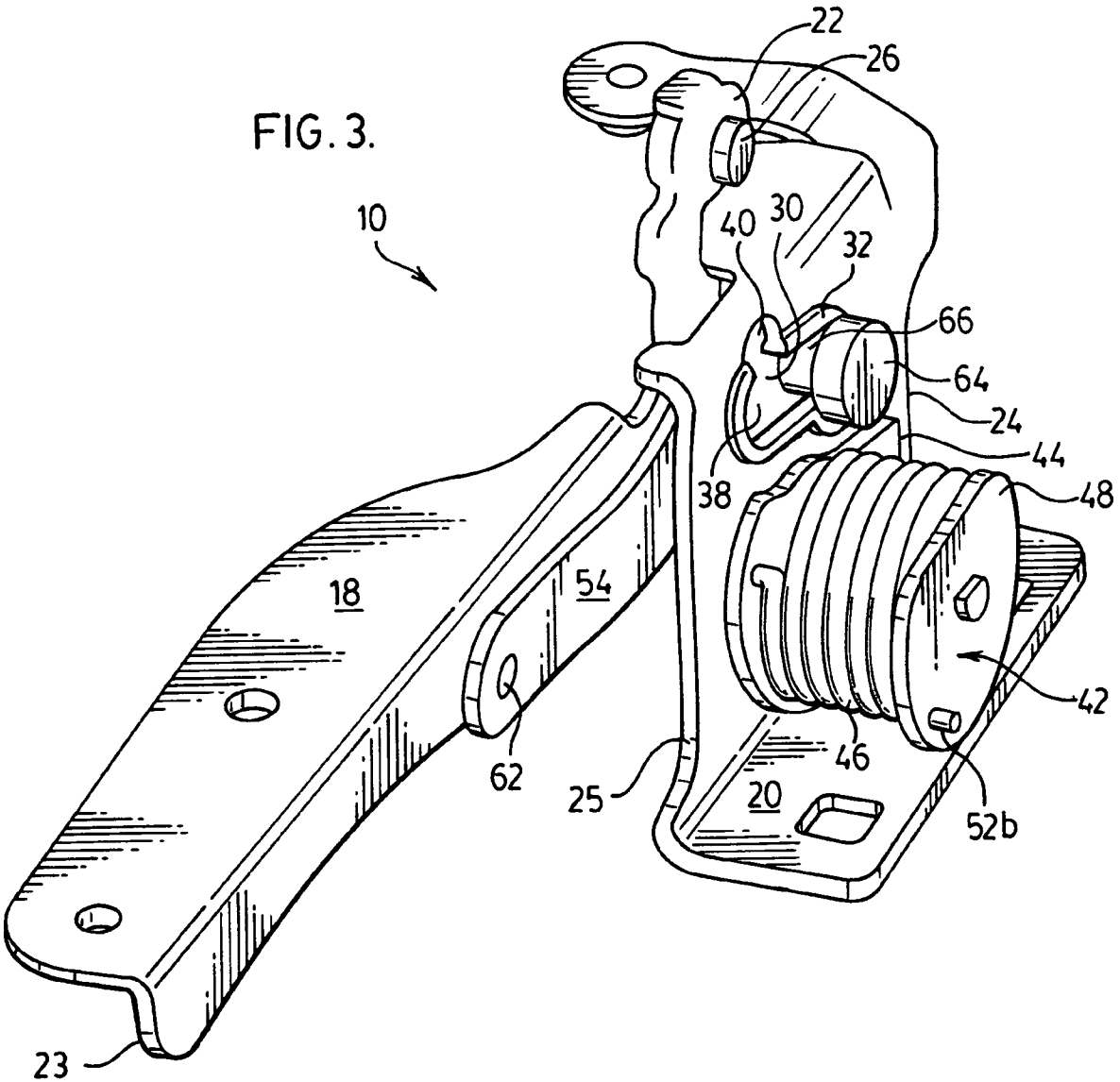
FIG. 3 illustrates a perspective view of the hinge assembly shown in FIG. 2 with the hinge arms positioned in an initial fully closed orientation.

Reference is first made to FIG. 1 which illustrates a vehicle 8 employing a pair of integrated hinge assemblies 10 used to pivotally secure a vehicle hood 12 at each of its sides to a car frame 14. The hinge assemblies 10 are configured to enable a user, using one hand, to both raise and secure the hood 12 in the fully opened position shown in FIG. 1 relative to the car frame 14, while enabling the hood 12 to be closed and secured from the front of the vehicle 8 by applying a predetermined minimum downward force thereon.

More particularly, as will be described, as shown best in FIG. 2, the hinge assemblies 10 are provided such that once the hood 12 (FIG. 1) is manually partially opened to a threshold angle $\alpha$, the hinge assemblies 10 thereafter provide a combined counterbalancing upward force which is equal to and preferably greater than the downward force applied by the weight of the hood 12, to automatically raise or assist in raising the hood 12 to the fully opened position of angle $\beta$. As a result, once the hood 12 is raised to critical angle, and preferably a critical angle $\alpha$ selected at between about 10 to 40°, and preferably about 12 and 20°, the hinge assemblies 10 alone are operable to self raise the hood 12 the remaining distance (angle $\beta$) without further manual effort, or with manual effort depending on manufacturer requirements.

FIGS. 3 to 8 illustrate the left-hand hinge assembly 10 used to hingely couple the hood 12 to the car frame 14, it being appreciated that the right-hand hinge assembly is formed having the mirror construction, and operable in the identical manner.

The hinge assembly 10 includes an upper hinge bracket or arm 18 which is adapted for securement to the hood 12 and a lower hinge bracket or arm 20 which is provided for mounting directly to the car frame 14. The upper and lower hinge arms 18,20 are preferably fabricated from steel, aluminum or other suitable metals or alloys, and extend respectively from rearwardmost ends 22,24 to forwardmost ends 23,25. The hinge arms 18,20 are pivotally coupled directly to each other towards their respective rearwardmost ends 22,24 by way of a hinge pivot 26 so as to movably support the hood 12 and be relatively movable relative to each other about a hinge axis $A_H$-$A_H$ (FIG. 4).

Figure 4:
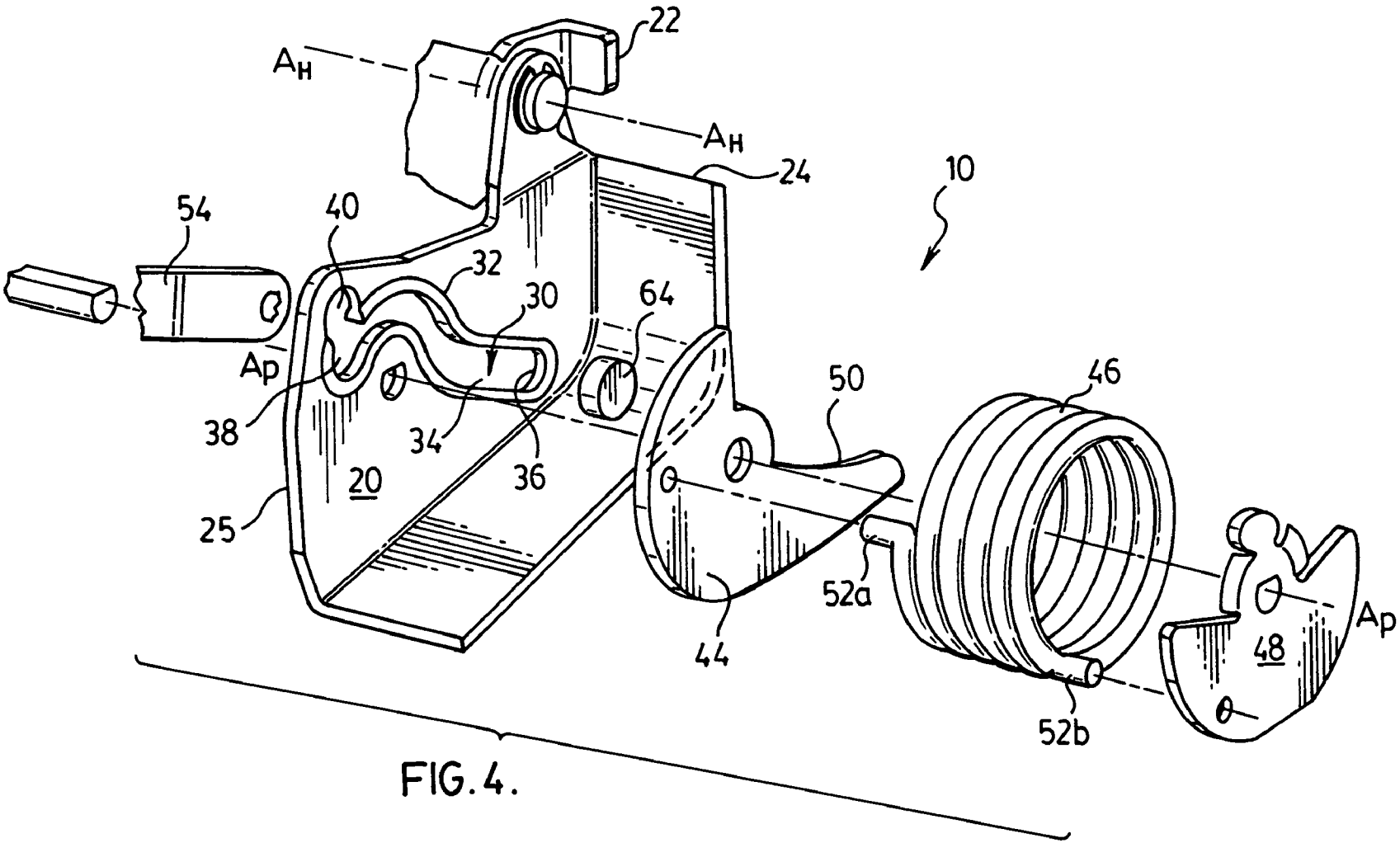
FIG. 4 illustrates a partial exploded view of the toggle assembly and a prop arm used in the hinge assembly of FIG. 3 in locking the hinge arms in a fully open configuration.
Figure 7:
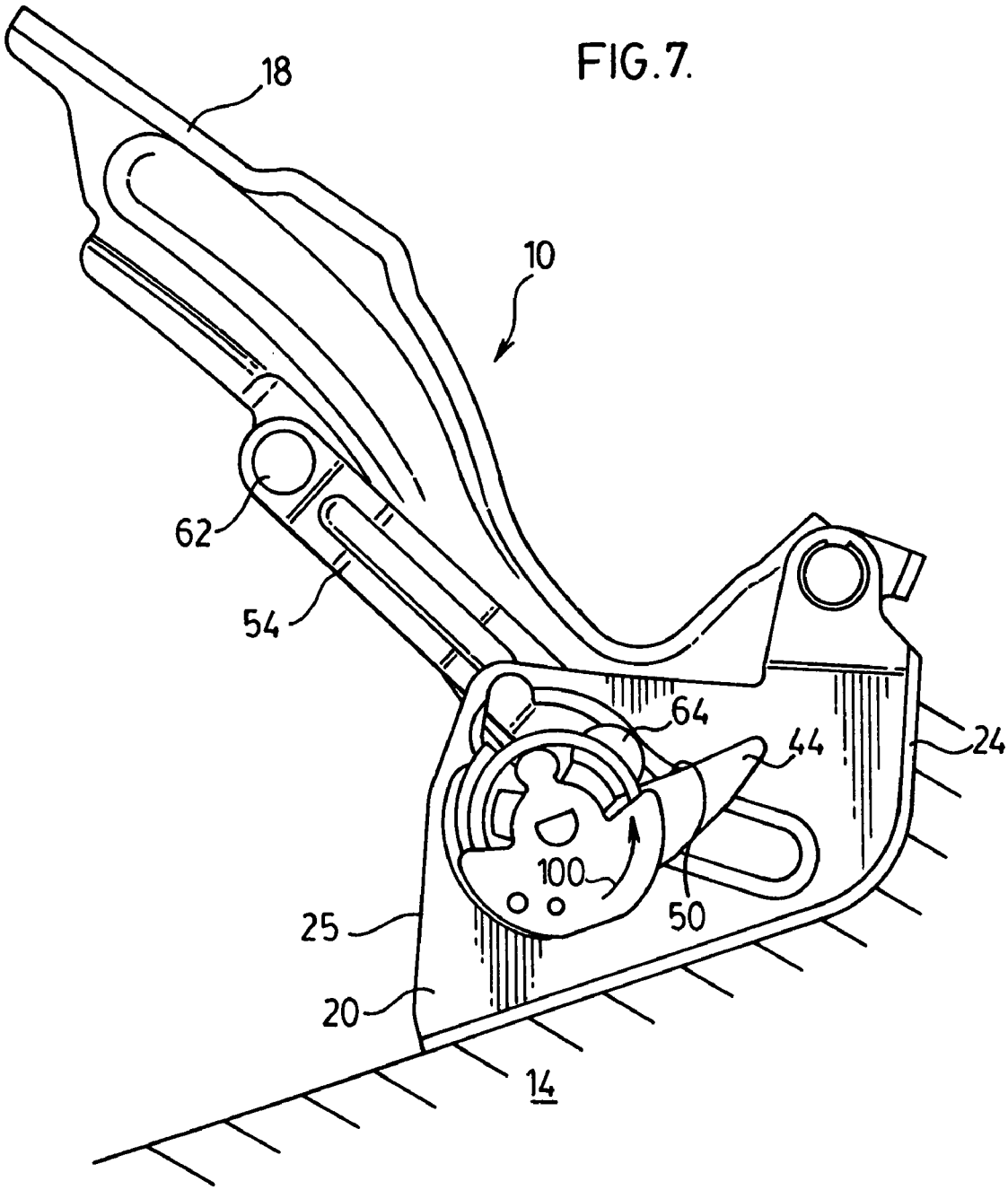
FIG. 7 illustrates a schematic side view of the hinge assembly shown in FIG. 5 with the hinge arms moved past a threshold open position wherein the toggle assembly provides a counterbalancing opening force thereon.
Figure 8:
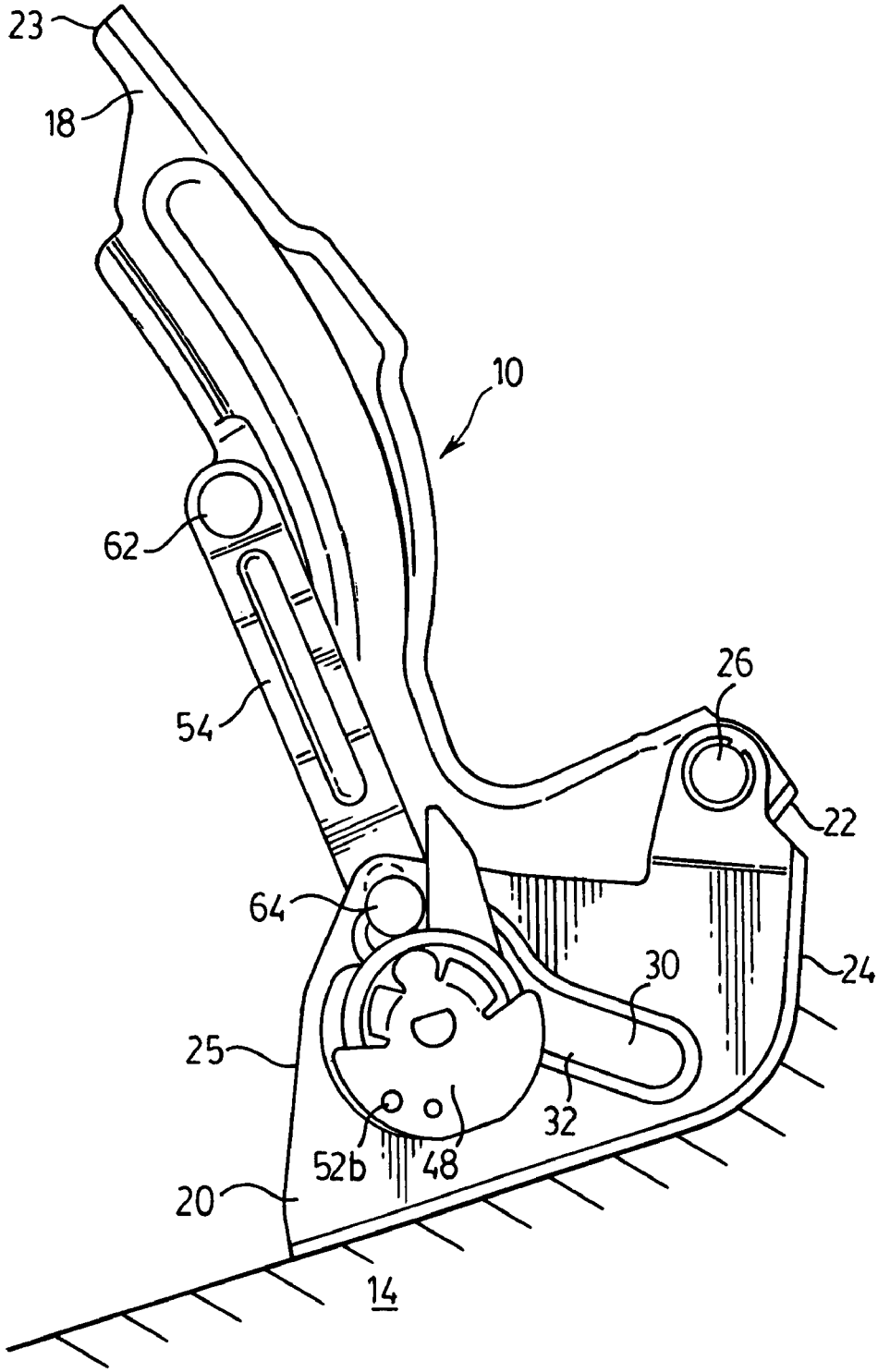
FIG. 8 illustrates a schematic side view of the hinge assembly of FIG. 5 with the hinge arms positioned in a fully opened configuration.

As shown best in the exploded view of FIG. 4, a guide slot 30 is formed through the lower hinge arm 20. Although not essential, the guide slot 30 is most preferably characterized by generally parallel sidewalls. The guide slot 30 includes a laterally extending rolled edge 32 which, as will be described, is provided to minimize component wear and enhance the overall hinge assembly life. The guide slot 30 includes a generally linear operational section 34 and a generally arcuate engaged section 38. The operational section 34 extends forwardly and angularly upwardly from a rearwardmost end or bight 36 to merge at its forwardmost end with the initially upwardly and forward curving arcuate section 38. Most preferably the arcute engaged section 38 includes a portion which extends radially about a path axis $A_P$ (FIG. 4) to a forwardmost upwardly projecting detent 40 at the forwardmost end of the slot 30. Although not required, the detent 40 advantageously permits the hood 12 to be moved to a more fully open position during vehicle assembly and manufacture.

FIG. 3 shows the hinge assembly 10 as including a rigid steel prop arm 54. The prop arm 54 is pivotally secured at its first end portion towards the forwardmost end 23 of the upper hinge arm 18 by means of a prop arm pivot 62. A guide bearing 64 is rotatably secured to the second other end of the prop arm 54. The guide bearing 64 is sized so as to be rotatably received within the guide slot 30 for movement therealong. As shown best in FIG. 3, the guide bearing 64 is provided with a live bearing 66 which extends laterally through the guide slot 30. As will be described, the live bearing 66 is provided such that in assembly, it is contacted by the rolled edge 32 and/or an engagement surface 50 of a toggle arm 44 to minimize component wear as the hinge arms 18,20 are opened and closed.

FIGS. 3 and 4 show best the lower hinge arm 20 as further having a toggle assembly 42 mounted thereto. The toggle assembly 42 includes a toggle arm 44, coil torsion spring 46, and cap plate 48. The toggle arm 44 is provided with a projecting finger portion which includes non-linearly extending curving engagement surface 50. The arm 44 is coupled to the hinge arm 20 for pivotal movement generally about the path axis $A_P$-$A_P$ such that the engagement surface 50 contacts the guide bearing 64 while being movable in a path of movement at least generally aligned with the engaged section 38 of the slot 30. Although not essential, the curvature of the engagement surface 50 is selected so as to orient generally normal to the engaged section 38 of the slot 30, as the arm 44 moves therealong.

Torsion coil spring 46 is provided with end portions 52*a*, 52*b* which engage respectively the toggle arm 44, and the cap plate 48 to provide a resilient biasing spring force on the toggle arm 44. In particular, the spring 46 resiliently biases the toggle arm 44 in the direction of arrow 100 (FIG. 5) to resiliently urge the engagement surface 50 forwardly towards the actively engaging position and forwardmost bight 40 of the slot 30. Most preferably, the arm 44 is reciprocally movable with the engagement surface 50 in engaging contact with the guide bearing 64 between a passively engaging position (shown in FIG. 5) wherein the engagement surface 50 is moved to an orientation generally parallel to and adjacent to the operational section 34 of the slot 30, and an actively engaging position (shown in FIG. 7) wherein the engagement surface 50 is oriented at least transversely to the direction of elongation of the engaged section 38 so as to provide a force on the guide bearing 64 forwardly along the slot 30.

Although not essential, most preferably the cap plate 48 is selectively positionable relative to the hinge arm 20. As such, by altering the position of the cap plate 48, it is possible to increase or decrease the tension applied by the spring 46 on the toggle arm 44. As such, by varying the tensioning of the spring force, the hinge assembly 10 may be adjusted to selectively vary the counterbalancing force applied to the hood 12. As such, the hinge assembly 10 is suitable for use with vehicle hoods 12 of different sizes or weights, to provide differing counter balancing forces.

In operation, the toggle assembly 42 selectively provides an upward opening force on the upper hinge arm 18, as the guide bearing 64 is moved from the operational section 34 and into the arcuate engaged section 38 of the slot 30. FIGS. 5 to 8 show best the hinge arms 18,20 as the forwardmost ends 23,25 are moved relative to each other about the hinge axis $A_H$-$A_H$ as the hinge assembly 10 is opened and closed. It is to be appreciated that as the hinge arms 18,20 are opened and closed, the pivotal coupling of the prop arm 54 to the upper hinge arm 18 result in the guide bearing 64 reciprocally moving along the guide slot 30 to extend or collapse the prop arm 54.

FIG. 5 shows the hinge assembly 10, initially when the hood 12 is fully closed, and the hinge arms 18,20 are oriented with their forwardmost ends 23,25 substantially in juxtaposed alignment at angle 0 (FIG. 2). In this position, the prop arm 54 is generally co-aligned with the hinge arm 18 and the guide bearing 64 of the prop arm 54 is moved rearwardly along the guide slot 30, locating immediately adjacent to the rearward bight 36.

As the hood 12 is initially raised, the upward pivoting movement of the hinge arm 18 relative to hinge arm 20 results in the forward sliding of the guide bearing 64 along the operational section 34 of the guide slot 30. While the guide bearing 64 moves along the operational section 34, the engagement surface 50 of the toggle arm 42 is maintained in a parallel orientation to the direction of elongation of the operational section 34 by its engagement with the bearing 64. In this orientation, the toggle assembly 42 passively engages the guide bearing 64, applying a neutral or zero forward force thereon in a direction which is lateral to the slot direction, and which otherwise does not provide a significant resistive or positive force on the initial opening of the hood 12. As a result, while the guide bearing 64 locates within the operational section 34, and until the hood 12 is raised to threshold angle $\alpha$, the hood 12 is lifted and lowered in a conventional manner, with the user providing the necessary manual upward lifting force thereon.

The continued upward lifting of the hood 12 effects movement of the guide bearing 64 into the arcuate engaged section 38, as the hood 12 is raised to the threshold angle $\alpha$. As shown best in FIGS. 7 and 8, as the guide bearing 64 moves into and along the arcuate section 38, the resilient force of the spring 46 urges the toggle arm 44 in the counter clockwise direction of arrow 100 about the path axis $A_P$. As a result, the engagement surface 50 is moved relative to and rearwardly of the guide bearing 64 so as to apply a gradually increasing forward force thereon, reaching a predetermined minimum force when the toggle arm 42 fully engages the bearing 64 such that the rear surface of the guide bearing 64 is directly forward of and engaged by the toggle arm 42. In this orientation, the toggle arm 42 provides a forward force on the bearing 64 which is generally aligned with the orientation of the guide slot, to drive the guide bearing 64 forwardly therealong. The forward force on the guide bearing 64 acts to cause the prop arm 54 to further force the hinge arm 18 upwardly, until the bearing 64 reaches the forward end of the slot 30 and the hinge arms 18, 20 and at the fully opened angle $\beta$. As the guide bearing 64 moves to the forwardmost end of the slot 30, the guide bearing 64 is positioned in alignment with the detent 40.

Most preferably, the spring 46 is provided with a spring tension which is selected such that when the guide bearings 64 are fully engaged by the toggle arm 42, the cumulative force of engaging contact between the toggle arm 44 and guide bearing 64 of the hinge arms 10 is generally equal to or greater than the rearward force applied by the downward weight of the hood 12 on the guide bearing 64 in the reverse direction. As a result, the springs 46 of the hinge assembly 10 allow the hood 12 to be manually raised with only minimum effort, or more preferably self raise the hood 12 open in movement once it has been manually raised to the threshold position $\alpha$ to the fully opened position shown in FIG. 1.

To close the vehicle hood 12 and return the hinge assemblies 10 to the initial position of FIG. 5, the user (not shown) applies a predetermined minimum downward force on the hood 12. The downward force is selected sufficient to urge the guide bearing 64 rearwardly against the force of the spring 46 out of alignment with the detent 40, and in the reverse direction of arrow 100 against the forward upward force of the toggle arm 44. As the downward force is applied, the engagement between the guide bearing 64 and the engagement surface 50, rotates the toggle assembly 42 clockwise in the reverse direction against the bias of the torsion spring 46 to reposition the toggle arm 44 in an orientation aligned with the longitudinal extent of the operation section 34 as shown in FIG. 6. It is to be appreciated that in closing, the spring 46 similarly provides a counterbalancing force against the weight of the vehicle hood 12 with the toggle arm 44 providing a decreasing forward force on the guide bearing 64 in the reverse manner, to prevent it from being lowered too quickly. Once the hood 12 is lowered to the threshold angle $\alpha$ and whereby the toggle arm 44 again passively contacts the guide bearing 64, the hood 12 may be closed via gravity in a conventional manner.

It is to be appreciated that by forming the operational section 34 as an angularly extending linear section allows the hood 12 to be fully closed without over-tensioning of the torsion spring 46. It is to be appreciated that in an alternate construction, the operational section of the guide slot 30 could be formed with a curving or other arcuate configuration, or omitted in its entirety, without departing from the spirit and scope of the invention.

Similarly, although FIGS. 5 to 8 illustrate the guide slot 30 as extending angularly and then curving upwardly, the invention is not so limited. While the detailed description of the embodiment illustrates the hinge assembly as including a torsion spring used to provide a biasing force on the toggle arm 44, the invention is not so limited. It is to be appreciated that various other types of biasing apparatus and/or members may also be employed without departing from the spirit and scope of the invention. Such devices would include, without limitation, electric motors, as well as single or multiple compression and tension coil springs, leaf springs, gas springs, gas shocks, and the like, either alone or in combination.

Figure 9:
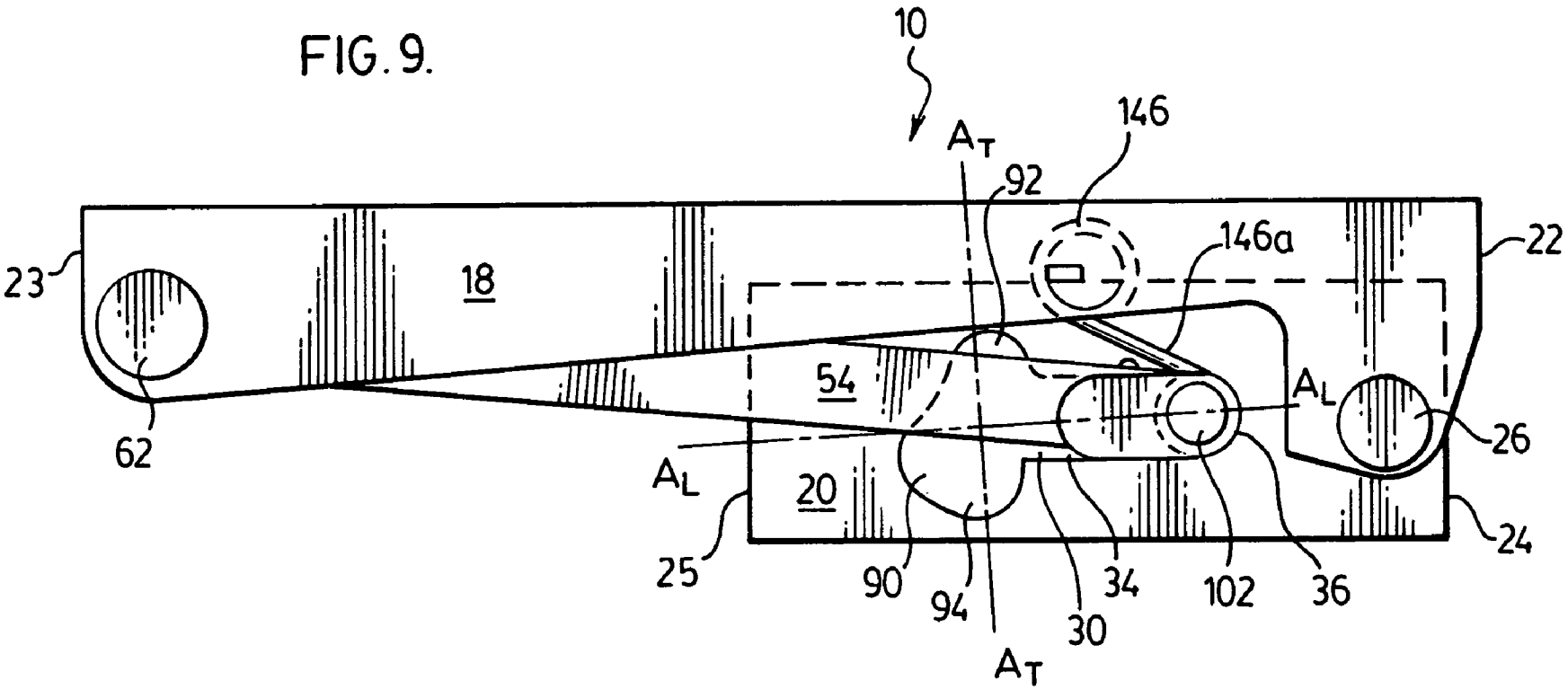
FIG. 9 illustrates a schematic perspective view of a first side of a hinge assembly in accordance with a further embodiment of the invention showing the hinge arms in a fully closed position.
Figure 11:
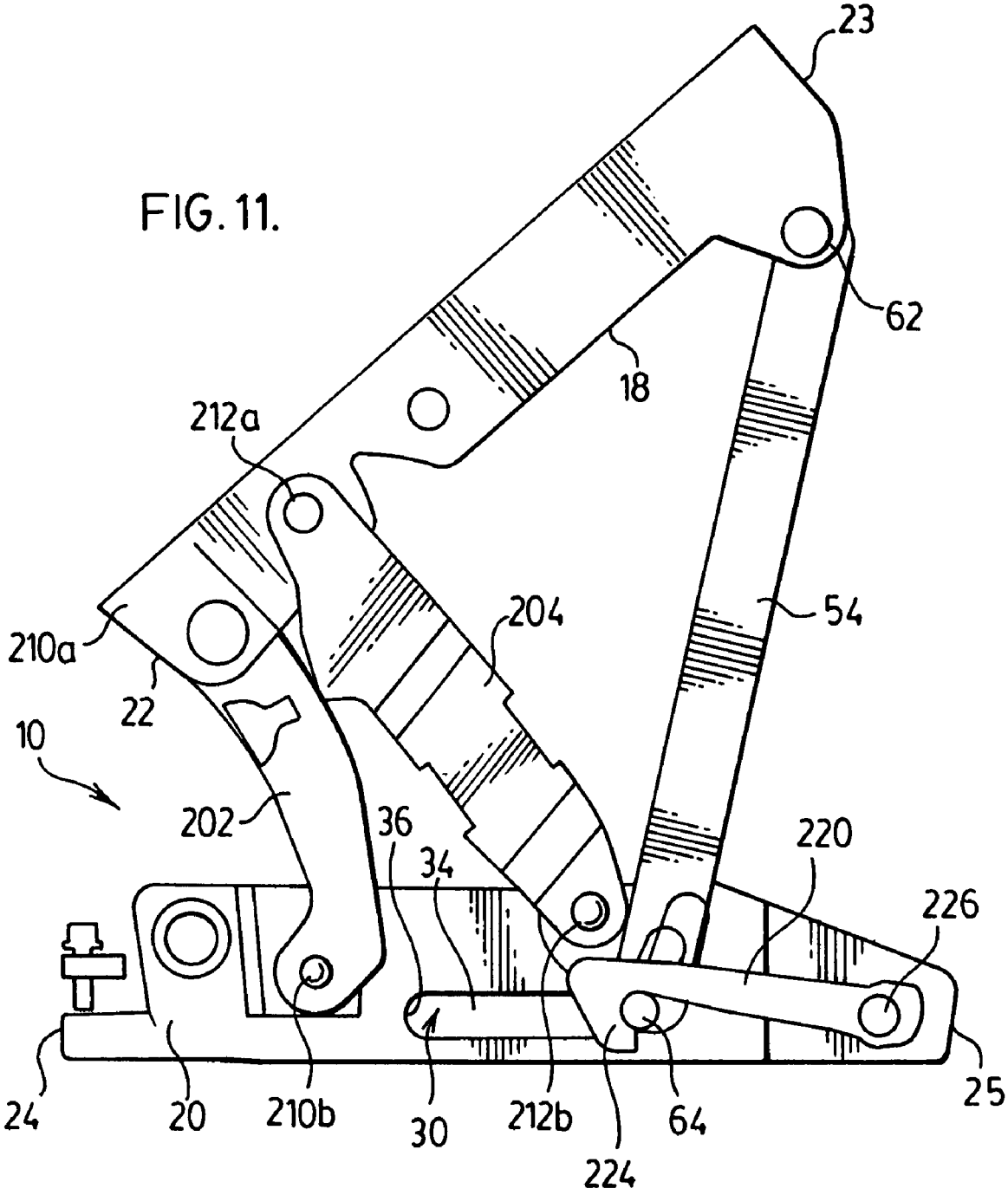
FIG. 11 illustrates schematically a perspective view of a first side of a hinge assembly in accordance with another embodiment of the invention, showing the hinge arms moved to a fully opened configuration.

Reference may be had to FIGS. 9 and 11 which illustrate alternate hinge assemblies 10 in accordance with the present invention, wherein like reference numerals are used to identify like components.

Figure 10:
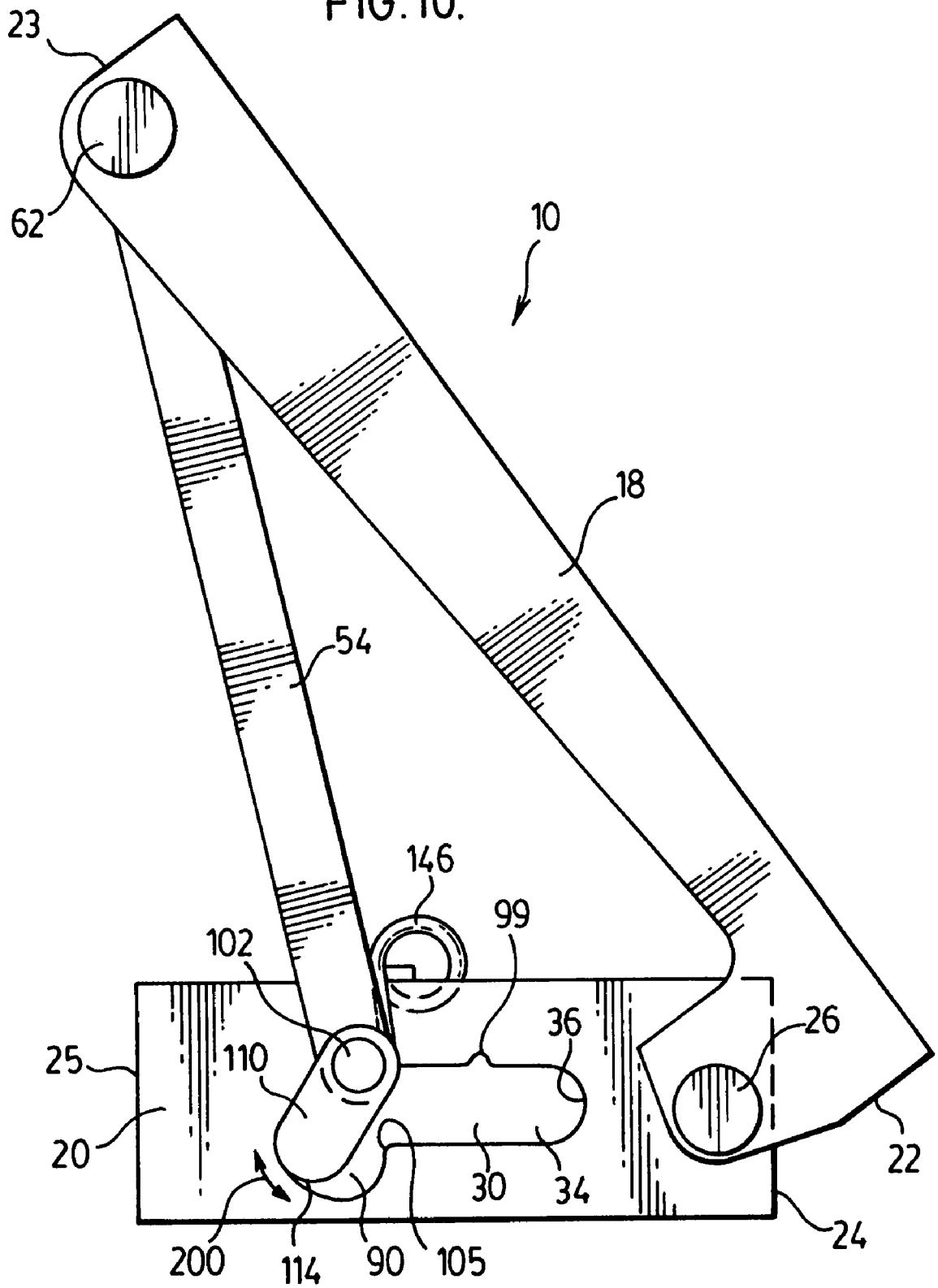
FIG. 10 illustrates schematically the hinge assembly of FIG. 9 showing the movement of the hinge arms and locking pawl towards a fully opened locked position.

In FIGS. 9 and 10, the guide slot 30 includes a generally horizontally extending operational section 34. The operational section 34 extends as a linear slot forwardly from rearwardmost end or bight 36 to merge with a forwardmost blind end section 90. In FIG. 9, operational section 34 of the slot 30 extends along a longitudinal axis $A_L$-$A_L$ which is substantially parallel to the longitudinal direction of elongation of the hinge arm 20. As shown best in FIG. 10, a groove 99 is preferably formed in the upper sidewall between the rearwardmost bight 36 and blind end 90.

The blind end 90 is provided with upper and lower detent portions 92,94 so as to be generally elongated in the direction of an axis $A_T$-$A_T$ which extends generally transverse to the longitudinal axis $A_L$-$A_L$ of the operational section 34. Although not essential, preferably the upper and lower detents 92,94 project away from the axis $A_L$-$A_L$ a distance past the respective upper and lower side surfaces and are defined laterally by respective front and rear shoulder surfaces. The lower detent 94 projects downwardly relative to the operational section 34 so as to preferably define a fulcrum point 105 as an angular abutment at the intersect between operational section 34 and lower detent.

FIG. 9 shows best the rigid steel prop arm 54 as being secured at its first end portion towards a forwardmost end 23 of the hinge arm 18 by means of prop arm pivot 62. A locking cam 110 is pivotally secured to the second other end of the prop arm 54 by means of a cam pivot 102 provided adjacent to its second other end. As shown in FIG. 10, the locking cam 110 is preferably provided with a generally parallel sided elliptical shape, and is elongated along a cam axis. The cam 110 has a lateral thickness selected to enable it to be slidably retained in the guide slot 30. Optionally, the locking cam 110 may be provided with one or more enlarged retaining flange surfaces or sides used to slidably retain the cam 110 within the guide slot 30, so as to prevent its lateral withdrawal therefrom. Most preferably, the locking cam 110 has a lateral width selected marginally less than that of the operational section 34 of the guide slot 30, and a length selected marginally less than the transverse length of the blind end 90. The blind end 90 has a lateral width in the direction of axis $A_L$-$A_L$, a height and width selected to permit the repositioning of a locking cam 110 therein in the selective locking and unlocking of the hood 12 in the raised position.

A coil torsion spring 146 is mounted by way of a support bracket (not shown) to the lower hinge arm 20 as an integral unit. As will be described, the spring 146 includes an end member 146*a* which is provided to selectively engage and bias the locking cam 110 forwardly in the slot 28, to assist in movement of the locking cam 110 into the blind end 34 of the guide slot 28 as the hood 12 is raised. The spring 146 advantageously acts in conjunction with the cam 110 to lock the hinge assembly 10 in the open position against a downward closing force selected less than a predetermined threshold downward force. Although not essential, in a most preferred construction, the spring 146 is provided as a tunable spring so as to exert differing forward forces on the prop arm 54 and/or locking cam 110, depending on the relative movement of the hinge arms 18,20 to each other. It is to be appreciated, however, that other spring arrangements including extension springs, coil springs, as well as other types of biasing mechanisms and/or springs may also be included on the hinge assembly 10, as part of the vehicle hood 12 or frame 14.

The cam 110 preferably is provided with a rounded forward edge surface 114 which in use of the hinge assembly 10 contacts the sides of the guide slot 30 to facilitate the relative repositioning of the cam 110. In particular, the cam 110 is repositionable between an operating position where the longitudinal cam axis is aligned with the operational section axis $A_L$-$A_L$, and a locking position where the cam axis is aligned with the transverse axis $A_T$-$A_T$. In this regard, the front shoulder of the lower detent 94 most preferably is formed as a caming surface which angles away from the axis $A_L$-$A_L$ initially forwardly and downwardly, and thereafter curves rearwardly so as to assist in effecting the rotational movement of the cam 110 about the cam pivot. The rear shoulder of the lower detent 94 most preferably has a curvature which is complementary to that of the lead edge of the cam 110 to facilitate its nesting contact seated thereagainst when in the locking orientation. Although not essential, most preferably the rear shoulder of the lower detent 94 merges with the side surface of the operational section 34 at an acute angle so as to define the fulcrum point 105 which when contacted by the cam 110, effects its repositioning with its longitudinal axis returned into re-alignment with the slot axis $A_L$-$A_L$.

As shown best in FIG. 9, the front shoulder of the upper detent 92 is most preferably located to enable the rear edge of cam 110 to assume an orientation seated thereagainst, when the cam axis is aligned with the blind end axis $A_T$-$A_T$, and most preferably oriented normal to the operational section axis $A_L$-$A_L$.

When the hood is initially closed, the upper and lower hinge arms 18,20 are positioned in an approximately parallel juxtaposed orientation shown in FIG. 9. In this initial position, the parallel alignment of the hinge arms 18,20 results in the cam pivot 102 and locking cam 110 being slid relative to the guide slot 30. Here the pivot 102 assumes an orientation immediately adjacent to the rearward bight 36, with the cam 110 projecting forwardly therefrom in an operating position, with the cam axis aligned with axis $A_L$-$A_L$, so as to be slidable therealong. Most preferably the rearward movement of the locking cam 110 results in the end of spring 146*a* being rotated upwardly by its contact with the side of the cam 110, so as to be moved through engaging contact therewith into the groove 99. It is to be appreciated that the relocation of the spring end 146*a* into the groove 99 results in the substantially unhindered and unbiased movement of the cam 110 and cam pivot 102 therepast, allowing the hood 12 to be opened or closed under its own weight.

As the hood 12 is moved to the fully open position, initially movement of the hinge arms 18,20 about the hinge pivot 26 results in the locking cam 110 being slid forwardly along the operational section 34 of the slot 30. Once the cam pivot 102 moves forwardly past the groove 99, the biasing end 146*a* of the spring 146 rotates downwardly against the rear of the cam 110. As a result of the compression forces of the spring 146, the engaging contact between the spring 146 and cam 110 urges the cam 110 forwardly. The engagement of the end of the spring 146 on the locking cam 100, in turn produces a counterbalancing upward force on the hinge arm 18, to assist in the opening of the hinge assembly 10 and the raising of the hood 12.

As the hood 12 continues to be raised, the forward edge 114 of the locking cam 110 is brought into bearing contact against the angular caming shoulder surface of the detent 94. This contact, combined with the forward force applied by the end of the spring 146, results in the cam 110 rotating about the pivot 102 in the direction of arrow 200 (FIG. 10) with its forwardmost edge 114 moving downwardly into the lower detent 94. Simultaneously, the rearward end of the cam 110 and the cam pivot 102 moving upwardly into the upper detent 92 in the manner shown in FIG. 10. As the hood 12 assumes the fully open orientation, the cam 110 assumes a locking orientation with its longitudinal cam axis substantially aligned with the transverse axis $A_T$-$A_T$, restricting its return movement of the pivot 102 into the operational section 34 of the slot 30. Furthermore, the biasing end of the spring 146 applies a forward force on the reoriented locking cam 110, to assist in maintaining it in the locked position below threshold return forces. Most preferably, the spring 146 is configured to maintain an offset forward force on the repositioned cam 110 under a downward load force selected less than a desired threshold minimum force, and which typically would be greater than that required to counterbalance the weight of the hood 12.

To close the hood 12, the user merely applies a downward force on the hood 12 which is sufficient to overcome the predetermined minimum threshold force applied by the spring 146 and which is necessary to effect the repositioning of the cam 110 in alignment with the axis $A_L$-$A_L$. The downward force on the hood 12 results in the movement of the hinge arms 18,20 about the hinge pivot 26. The relative movement of the hinge arms 18,20 in turn results in the prop arm 54 urging the locking cam 110 rearwardly against the fulcrum point 105. This contact in turn effects a reorientation of the cam 110 to resume a position aligned with the axis $A_L$-$A_L$, allowing the cam 110 and cam pivot 102 to slide rearwardly into and along the operational section 34 of the guide slot 30. The continued rearward movement of the cam 110 along the guide slot 30 initially moves against the bias of the spring 146, providing a counterbalancing force to the weight of the hood 12 up to the point where the spring is slid to the side of the cam 110 into the groove 99. The inventors have appreciated that by repositioning the spring end 146*a* into the groove 99 when the hood 12 is in the normally closed position, the spring 146 is typically maintained in a less distorted state, as contrasted, for example, when the spring 146 is used to continuously provide a biasing force on the cam member 110, prolonging spring life.

The construction of the present invention advantageously enables use of multiple hinge assemblies 10 in vehicle or other closure panel applications.

Although the detailed description describes the hinge assembly 10 as being used in the securement of a vehicle hood 12, it is to be appreciated that the hinge assembly 10 is equally suitable for other applications. By way of non-limiting example, the hinge assembly could also be used in the hinged coupling of lift gates, hatchbacks, vehicle doors, trunks, or other closure access panels used in trucks, buses, automobiles, aircraft, railcars, furniture and the like, without departing from the spirit and scope of the invention.

While the preferred embodiment describes the presence of a guide slot 30 formed in the lower hinge arm 20 as presenting a simplified construction, it is to be appreciated that the guide slot 30 could be provided in the upper hinge arm 18 or as a separate part or component altogether. Similarly, if desired, the prop arm 54 could be pivotally secured either directly to the hood 12 or closure panel, or to other closure panel elements apart from the upper hinge arm 18 without departing from the spirit and scope of the invention.

While the Figures have described the integrated hinge assembly 10 as including upper and lower hinge arms 18,20 for simplification, it is to be appreciated that the hinge could be equally provided in inverted arrangement to that shown.

Although the preferred embodiment of the invention describes a hinge assembly 10 as having two pivot arms 18,20, the present invention could equally be used with other hinge assemblies having multiple hinge bar constructions, including those having pivotally connected linkage arms. Reference may be had to FIG. 11 where the hinge assembly 10 is provided which is of a four-bar hinge construction. In FIG. 11, a pair of connecting arms 202,204 are used to secure the hinge arms 18,20 for movement pivotally relative to each other. The connecting arm 202 is pivotally secured respectively to the rearwardmost ends 22,24 of the upper and lower hinge arms 18,20 by pivots 210*a*, 210*b*, respectively. The connecting arm 204 is secured to the upper and lower hinge arms 18,20 by way of pivots 212*a*, 212*b*, respectively at points forwardly from the pivots 210*a*, 210*b*.

In FIG. 11, a reciprocally movable catch arm 220 is furthermore provided to assist in locking the hinge assembly 10 with the arms 18,20 moved in an open orientation. The catch arm 220 includes a hooked end 224 which is pivotal about an arm pivot 226 between a lowered position, where the end 224 is moved into engaging contact with guide bearing 64 so as to prevent its return movement along the operational section 34 of the slot towards rearward bight 36, and a position raised thereabove and which is selected to permit substantially free sliding movement of the guide bearing 64 along the slot 30. A spring (now shown) is preferably provided to resiliently bias the guide bearing 64 forwardly along the slot 30 into engaging contact with the hooked arm 220. A crank member, locking pin or biasing spring may be provided to selectively retain the hooked end 224 in the release position to permit the collapse of the hinge arms 18,24 in the closing of a hood.

Although the detailed description describes the hinge assembly 10 as including a pair of hinge arms 18,20 which are provided for mechanical coupling to the vehicle hood 12 and frame 14, the invention is not so limited. It is to be appreciated that the hinge assembly 10 could equally be provided with either the hood 12 or frame 14 functioning as the equivalent to a hinge arm, with the guide slot 30 or a corresponding guide groove or member provided therein.

Although FIG. 1 illustrates the vehicle 8 as employing a pair of integrated hinge assemblies 10, it is to be appreciated that the invention is not so limited. In an alternate construction, the vehicle 8 could be provided with only a single hinge assembly 10, with the second other standard hinge being provided to pivotally secure the hood 12 for movement relative to the frame 14.

Although the detailed description describes and illustrates various preferred embodiments, the invention is not so limited. Many modifications and variations will now occur to persons skilled in the art. For a definition of the invention, reference may be had to the appended claims.

We claim:

1. A hinge arm assembly comprising a first pivot member and a second pivot member, each of the first and second pivot members extending from a respective proximal portion to a distal portion, the first and second pivot members being coupled for pivotal movement relative to each other about a hinge pivot disposed towards their respective proximal portions, a generally elongated guide member associated with said second pivot member, the guide member including an operational section and an engaged section, and extending forwardly from a proximalmost end disposed towards the proximal portion of the second pivot member, to a distalmost end disposed towards the second member distal portion, a prop arm extending from a first arm end to a second arm end, the first arm end being pivotally coupled to the first pivot member for movement relative thereto about an arm pivot spaced from the hinge pivot towards the distal portion of the first pivot member, the second arm end being movable generally along the guide member as the first pivot member is moved about the hinge pivot relative to the second pivot member, a biasing assembly engaging the prop arm, the biasing member resiliently biasing the second arm end towards the distalmost end of the guide member as the second arm end moves along the at least part of the engaged section to restrict return movement of the second arm end from the engaged section into the operational section absent a predetermined threshold force.

2. The assembly as claimed in claim 1 wherein the biasing assembly includes a resiliently deformable spring, and when the second arm end is moved to the operational section, the biasing assembly permitting substantially unhindered sliding movement of the second arm end relative to the guide member.

3. The assembly as claimed in claim 2 wherein the spring comprises a torsion spring and said biasing assembly further includes a movable engagement member which is engaged by said spring, the engagement member being resiliently movable against the bias of the spring and including a contact surface for contacting at least part of the prop arm, the contact surface being movable between a first position disposed towards the distalmost end of the guide and a second position moved rearwardly therefrom towards the proximalmost end, whereby the contact surface of engagement member is engagable with the prop arm when the second arm end locates in the engagement section to bias the second end towards the distalmost end.

4. The assembly as claimed in claim 3 wherein the prop arm includes a bearing member disposed towards the second arm end, the engagement section of the guide member including a generally arcuate portion along a generally arcuate path spaced radially from a point axis, with the operational section of the guide member extending in a generally linear orientation the engagement member including an elongated contact surface which is rotatable about the point axis, whereby in the first position, the contact surface being oriented generally parallel to the linear extent of operational section so as to passively engage the bearing member when located therein, and in the second position, the contact surface extending generally transverse to the arcuate portion to actively engage the bearing member so as to resiliently bias it towards the distalmost end.

5. The assembly as claimed in claim 4 wherein the prop arm comprises an elongate metal arm.

6. The assembly as claimed in claim 5 wherein the guide member comprises a guide slot formed through said second pivot member.

7. The assembly as claimed in claim 6 wherein the guide slot further includes a forwardmost detent spaced generally adjacent the distalmost end.

8. The assembly as claimed in claim 1 wherein the first pivot member comprises a generally elongated first hinge arm, the second pivot member comprising a second hinge arm, a pivot pin mechanically coupling the proximal portion of the first pivot arm to the proximal portion of the second hinge arm.

9. The assembly as claimed in claim 8 wherein said hinge arm assembly is a vehicle hinge assembly for pivotally securing a closure panel selected from the group consisting of a vehicle hood, a vehicle trunk, deck lid, and a vehicle lift back, to a vehicle frame, said first pivot arm being configured for securement to the closure panel, with the second pivot arm being configured for attachment to the frame.

10. The assembly as claimed in claim 9 whereby when the closure panel is moved to the closed position, the distal portions of the first and second pivot members being moved towards a juxtaposed position, and in the open position the distal portions being moved apart relative therefrom, the guide member comprising a guide slot formed in said second hinge arm, the engaged section extending along a generally arcuate path spaced radially from a point axis, the biasing assembly including a movable engagement member mounted for engaging contact with a sliding member mounted to said prop arm and being slidable relative to the slot, the engagement member being resiliently movable between a release position when said sliding member locates in the operational section, so as not to substantially interfere with rearward movement of the sliding member along said operational section of said slot, and an engaged position when said sliding member locates in the engaged section, wherein said engagement member engages said prop arm to provide a predetermined minimum forward force thereon, to assist in forward movement of the sliding member along the slot.

11. The assembly as claimed in claim 1 wherein the engaged section of the guide member including an arcuate portion extending along a generally arcuate path spaced radially from a point axis, the operational section extending generally linearly forward from a rearwardmost bight proximate to said proximal portion, to merge with said engaged section, the biasing assembly comprising a torsion spring secured to the second pivot member, an engagement member coupled to said spring, the engagement member being reciprocally movable against the bias of the spring along said radial path between a first position moved towards the proximal portion of the second pivot arm and a second position moved towards the distal portion of the second arm.

12. The hinge assembly as claimed in claim 11 wherein the first and second pivot members comprise respectively first and second pivot arms, the first and second pivot arms being movable relative to each other between fully opened and closed positions, wherein in the fully open position, said second arm end is moved towards the distalmost end of the guide member with the distal portions moved a first distance apart, and in the closed position, the second arm end locating towards the proximalmost end of the guide member, and the distal portions being moved closer together a second distance apart selected less than said first distance.

13. The assembly as claimed in claim 12 wherein said hinge arm assembly is a vehicle hinge assembly for pivotally securing a vehicle hood to a vehicle frame, said first hinge arm being configured for securement to the vehicle hood, with the second pivot member being configured for attachment to the frame.

14. The hinge assembly as claimed in claim 13 wherein the weight of the hood on the first hinge arm provides a rearward biasing force on the second arm end, the spring being selected such that said engagement member provides a forward biasing force in the second arm member greater than the rearward biasing force when the second arm end is moved to the engaged section.

15. The assembly as claimed in claim 1 wherein the first pivot member comprises a generally elongated pivot arm, a pivot pin mechanically coupling the proximal portion of the first pivot arm to the proximal portion of the second pivot member.

16. A hinge arm assembly comprising first and second hinge arms, each of the hinge arms extending from a respective proximal end to a distal free end and being coupled for pivotal movement relative to each other about a hinge pivot located towards the distal ends for movement between a closed position, wherein the free ends of said hinge arms are moved towards juxtaposition, and an open position, wherein the free ends are moved apart, a guide slot formed in said second hinge arm and extending forwardly from a proximalmost end disposed towards the proximal end of the second hinge arm to a distalmost end disposed towards the free end of said second hinge arm, an elongated prop arm pivotally coupled at a first end to the first hinge arm at a pivot point spaced from the hinge pivot towards the first arm free end, a bearing member secured to the second end of the prop arm and being slidably received in the guide slot for movement therealong, whereby movement of the hinge arms from the closed position to the open position effects sliding movement of the bearing member forwardly along the slot from a first position moved proximate to the proximalmost end, to a second position moved proximate to the distalmost end, a biasing member, and an engagement member resiliently biased by the biasing member in engagement with the prop arm to urge the bearing member forwardly along the slot.

17. The assembly as claimed in claim 16 wherein the engagement member including a contact surface for engagingly contacting the bearing member, the contact surface being reciprocally movable along an arcuate path spaced radially from a point axis between a first position and a biased second position moved radially therefrom, the guide slot including a forwardmost radial portion, wherein the contact surface is movable substantially along the radial portion.

18. The assembly as claimed in claim 17 wherein the biasing member comprising a resiliently deformable spring resiliently biasing the contact surface from the first position, where said contact surface passively engages the bearing member so as not to substantially interfere with its movement along the slot, to a second position moved radially from the first position, in the second position to contact surface actively engaging the bearing member to urge the bearing member forwardly along the slot with a forward force.

19. The assembly as claimed in claim 16 wherein the biasing member includes a torsion spring, the engagement member coupled to said spring, the engagement member being reciprocally movable against the bias of the spring about an arcuate path spaced radially from a pivot axis between a first position and a second position spaced radially therefrom, a forward portion of the slot comprising a generally curved portion, whereby as the second arm end moves into the curved portion contact between the engagement member and the prop arm biases the second end towards the distalmost end of the guide slot.

20. The assembly as claimed in claim 19 wherein the engagement member includes a longitudinally extending contact surface for contacting the bearing member, the slot further including a proximalmost longitudinal section, the contact surface being movable to a position adjacent the longitudinal section as the bearing member is moved therealong, so as not to substantially interfere with the sliding movement of the bearing member therein.

21. The hinge assembly as claimed in claim 16 wherein the bearing member includes a live bearing, the engagement member including a contact surface positioned for contact with said live bearing as the hinge arms are opened and closed.

22. The assembly as claimed in claim 19 further including a mounting bracket for securing the spring to the second hinge arm, the mounting bracket being adapted to permit selective positioning of the spring relative to the hinge arm to effect adjustment in the spring tension on the engagement member.

23. The hinge arm assembly as claimed in claim 20 wherein the longitudinal section of the slot extends angularly upwardly towards the first hinge arm in a forward direction, when the hinge arms are moved to the closed position.

24. An automobile hinge assembly for hingely coupling an automobile hood to a vehicle frame so as to be selectively movable between open and closed positions about a hinge pivot, the hinge assembly comprising a first hinge arm coupled to one of said hood and said frame, and a second hinge arm coupled to the other of said hood and said frame, each of the hinge arms extending forwardly from a respective proximal end disposed towards said hinge pivot to a distal end remote therefrom, whereby when the hood is moved to the closed position, the distal ends of the hinge arms being moved towards a juxtaposed position, and in the open position the distal ends being moved apart relative therefrom, a guide slot formed in said second hinge arm, the slot including a rearwardmost operational section and an engaged section forwardly from the operational section, the engaged section including a curving portion extending along a generally arcuate path radially spaced from a point axis, a prop arm pivotally coupled at a first end to the first hinge arm at a pivot point spaced forwardly from the hinge pivot, the second other end of the arm including a sliding member slidably engaging said slot for movement therealong, whereby movement of the hood from the closed position to the open position effects sliding movement of the sliding member forwardly along the slot from a rearwardmost position in the operational section to a forwardmost position in the engaged section, a biasing member, an engagement member mounted for engaging contact with the sliding member and being resiliently biased by the biasing member, the engagement member being movable between a release position wherein said engagement member does not substantially interfere with rearward movement of the sliding member along said operational section of said slot, and an engaged position wherein said engagement member engages said prop arm to provide a forward force thereon to assist in forward movement of the sliding member along the engaged section towards the forward position.

25. The hinge assembly as claimed in claim 24 wherein the forward force applied by the engagement member to the sliding member increases to a predetermined force as said sliding member initially moves forwardly along said engaged section, the predetermined force being selected generally equal to or greater than a rearward force on the sliding member supplied by the weight of the hood when said sliding member is in said engagement section.

26. The hinge assembly as claimed in claim 25 wherein the biasing member includes a torsion spring mounted to said second hinge arm, the engagement member being biased by the spring for movement generally circumferentially about said point axis.

27. The hinge assembly as claimed in claim 26 further including a mounting bracket for securing the spring to the second hinge aim, the mounting bracket being adapted to permit selective positioning of the spring relative to the hinge arm to effect adjustment in the spring tension on the engagement member.

28. The hinge assembly as claimed in claim 25 wherein said operational section of the slot comprises a generally linearly extending section, and as said hood is moved to the closed position, the engagement member being movable to said release position by the engagement of the said sliding member as it moves rearwardly into the operational section of the slot.

29. The hinge assembly as claimed in claim 28 wherein said engaged section curves forwardly to a forwardmost blind end.

30. The hinge assembly as claimed in claim 29 wherein the sliding member includes a live bearing, the engagement member including a contact surface positioned for contact with said live bearing as the hood is opened and closed.

31. A hinge assembly for hingely coupling a closure panel to a frame so as to be selectively movable between an open and closed position about a hinge pivot, the hinge assembly comprising a first hinge arm coupled to one of said closure panel and said frame, and a second hinge arm coupled to the other of said panel and said frame, each of the hinge arms extending forwardly from a respective proximal end disposed towards said hinge pivot to a distal end remote therefrom, whereby when the panel is moved to the closed position, the distal ends of the hinge arms being moved towards a juxtaposed position, and in the open position the distal ends being moved apart relative therefrom, a guide slot formed in said second hinge arm, the slot including a rearwardmost operational section and an engaged section forwardly from the operational section, the engaged section extending along a generally arcuate path radially about a path axis, a prop arm pivotally coupled at a first end to the first hinge arm at a pivot point spaced forwardly from the hinge pivot, the second other end of the arm including a bearing member slidably engaging said slot for movement therealong, whereby movement of the hood from the closed position to the open position effects forward sliding movement of the bearing member along the slot from a rearwardmost position in the operational section to a forwardmost position in the engaged section, a toggle member mounted for selective engaging contact with the bearing member and being movable between a release position moved relative to said slot where said toggle member passively engages the bearing member so as not to substantially interfere with rearward movement of the bearing member along the slot, and an engagement position wherein said toggle member actively engages said bearing member to provide a forward force thereon to assist in forward movement of the bearing member along the slot towards the forward position, said toggle member being operable to apply a predetermined minimum force on said bearing member selected greater than a rearward force on the bearing member supplied by the weight of the closure panel when said bearing member is moved along at least part of said engaged section a spring mounted to said second hinge arm, the toggle member being resiliently biased by the spring for movement generally circumferentially about said path axis.

32. The hinge assembly as claimed in claim 31 further including a mounting bracket for securing the spring to the second hinge arm, the mounting bracket being adjustable to permit selective tensioning of the spring relative, to effect adjustment in the biasing tension on the toggle member.

33. The hinge assembly as claimed in claim 31 wherein said operational section of the slot comprises a generally linearly extending section extending forwardly and towards said first hinge arm, and as said closure panel is moved to the closed position, the toggle member being positionable in said release position moved adjacent to the operational section of the slot.

34. The hinge assembly as claimed in claim 33 wherein said engaged section curves forwardly towards the distalmost end of said first hinge arm, a forwardmost end portion of the engaged section including a detent.

35. The hinge assembly as claimed in claim 34 wherein the bearing member includes a live bearing, the toggle member including a contact surface positioned for contact with said live bearing as the bearing member moves relative to said slot.

36. The hinge assembly as claimed in claim 31 wherein the hinge assembly is a vehicle hinge assembly and the closure panel is selected from the group consisting of a vehicle hood, a vehicle trunk and a vehicle lift back.

* * * * *